US007399074B2

(12) United States Patent
Aldrich et al.

(10) Patent No.: US 7,399,074 B2
(45) Date of Patent: Jul. 15, 2008

(54) INK TANK FOR A PRINTHEAD

(75) Inventors: Charles Stanley Aldrich, Nicholasville, KY (US); James Harold Powers, Lexington, KY (US); Bhaskar Ramakrishnan, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 300 days.

(21) Appl. No.: 11/241,238

(22) Filed: Sep. 30, 2005

(65) Prior Publication Data

US 2007/0076066 A1 Apr. 5, 2007

(51) Int. Cl.
*B41J 2/175* (2006.01)

(52) U.S. Cl. ..... 347/86

(58) Field of Classification Search ..... 347/7, 347/19, 86, 87

See application file for complete search history.

(56) References Cited

U.S. PATENT DOCUMENTS 5,453,771 A * 9/1995 Waseda et al. ..... 347/86
5,790,158 A * 8/1998 Shinada et al. ..... 347/86
5,805,188 A * 9/1998 Nakajima et al. ..... 347/87
5,877,794 A * 3/1999 Takagi ..... 347/87
6,302,533 B1 * 10/2001 Shimomura et al. ..... 347/86
6,325,500 B1 * 12/2001 Kitabatake et al. ..... 347/86

* cited by examiner

*Primary Examiner*—Anh T. N. Vo
(74) *Attorney, Agent, or Firm*—Dinsmore & Shohl, LLP

(57) ABSTRACT

An ink tank for an inkjet printing device that includes a housing for containing ink, first and second chambers within the housing, and a partition separating the first and second chambers. The ink tank also includes a communication port connecting the first chamber in fluid communication with the second chamber, a tank outlet disposed within a wall of the housing, and a high capillary pressure producing member in direct communication with the outlet. The ink tank may be configured such that the ink may flow from the free ink space through the capillary pressure producing member and exit the outlet without having to travel through the communication port.

20 Claims, 3 Drawing Sheets

INK TANK FOR A PRINTHEAD

FIELD OF THE INVENTION

The present invention generally relates to printing systems. More particularly, the present invention relates to a ink tank for printheads such as an inkjet wide-feature printhead.

BACKGROUND OF THE INVENTION

Conventional printing devices generally include one or more ink tanks that store ink and supply it to a printhead such as a thermal inkjet printhead. By way of example, inkjet printing is a conventional technique by which printing is normally accomplished without contact between the printing apparatus and the substrate, or medium, on which the desired print characters are deposited. Conventional inkjet printing devices such as a fax, printer, photo printer, all-in-one device, plotter, or any other device incorporating inkjet printing technology typically include one or more ink tanks in which ink is stored and supplies ink from the tank to one or more inkjet printheads, which dispense the ink for printing. In one embodiment of the inkjet printing device, the ink tank and printhead are generally placed within a movable print carriage of the inkjet device. In another embodiment, the ink tank is fixedly connected to the inkjet device while the printhead is connected to the movable print carriage. In still another embodiment of the inkjet printing device, both the printhead and ink tank are combined into single unit print cartridge connected to a movable carriage.

Due to conventional ink tank designs, such tanks can provide very inconsistent ink pressure to the inkjet printhead, which can cause high variability in the ink jetting operation. This high variability in the ink jetting operation can create high variability in the print quality of the final product, which is very undesirable. Another opportunity for improvement with conventional ink tanks is the depriming of the printhead, which can cause the printhead to fail. This can occur if printing continues after the ink tank has been emptied of all its ink.

Accordingly, there is a need for an improved ink tank.

SUMMARY OF THE INVENTION

Accordingly, the present invention is intended to address and obviate problems and shortcomings and otherwise improve previous ink tanks for inkjet printing devices.

One exemplary embodiment of the present invention is an ink tank for an inkjet printing device. The ink tank includes a housing for containing ink, first and second chambers within the housing, and a partition separating the first and second chambers. The ink tank also includes a communication port connecting the first chamber in fluid communication with the second chamber, a tank outlet disposed within a wall of the housing, and a high capillary pressure producing member in direct communication with the outlet. Capillary pressure, as used herein, denotes the magnitude of vacuum (with respect to the ambient atmosphere), that characterizes the physical state of the ink mass under consideration.

Another exemplary embodiment of the present invention is an ink tank for an inkjet printing device. The ink tank includes a housing, first and second chambers for containing ink disposed within the housing, and a partition separating the first and second chambers. The ink tank also includes a communication port connecting the first chamber in fluid communication with the second chamber, a capillary pressure producing member disposed within the second chamber, a tank outlet disposed within a wall of the second chamber, and a first space for containing free ink disposed within the second chamber such that ink may flow from the first space through the capillary pressure producing member and exit the outlet without having to travel through the communication port.

Still another exemplary embodiment of the present invention is an ink tank for an inkjet printing device. The ink tanks include a housing, first and second chambers for containing ink disposed within the housing, a communication port connecting the first chamber in fluid communication with the second chamber, a tank outlet disposed within a wall of the housing, a capillary pressure producing member disposed above the outlet, and a first space for containing free ink disposed above the capillary pressure producing member within the housing such that free ink may flow substantially downward from the first space through the capillary pressure producing member and exit the outlet.

BRIEF DESCRIPTION OF THE DRAWINGS

While the specification concludes with claims particularly pointing out and distinctly claiming the invention, it is believed the same will be better understood from the following description taken in conjunction with the accompanying drawings in which:

Figure 1:
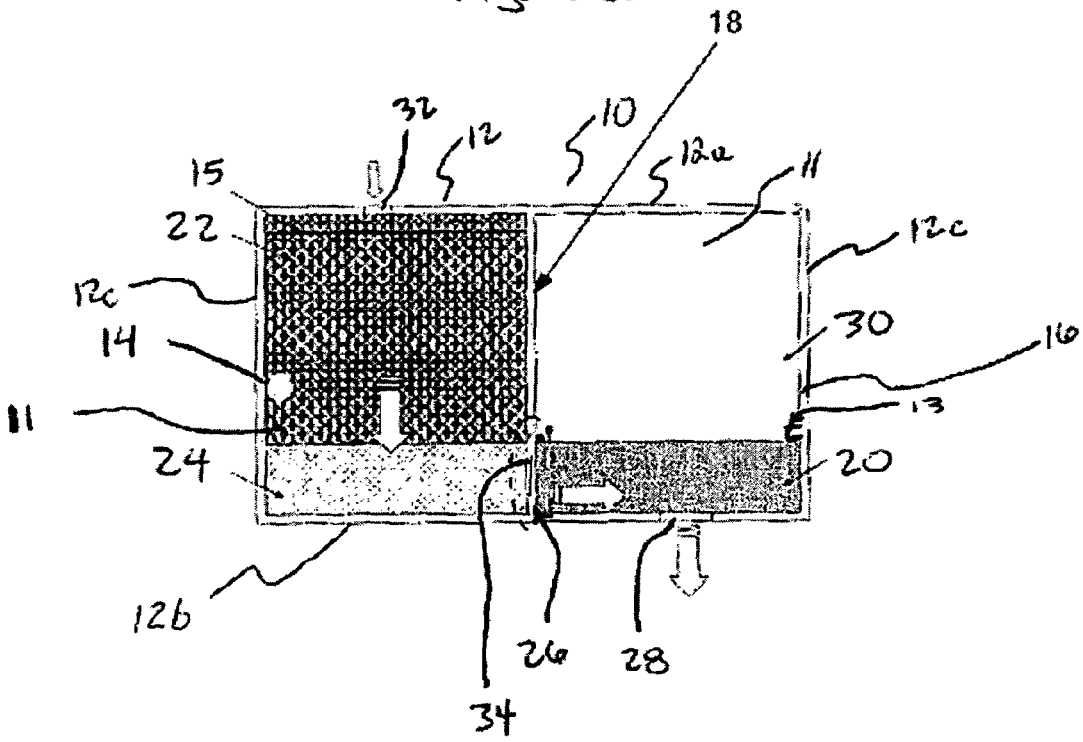
FIG. 1 is a schematic representation of an exemplary embodiment of the ink tank for an inkjet printing device according to the present invention.

The embodiments set forth in the drawings are illustrative in nature and not intended to be limiting of the invention defined by the claims. Moreover, individual features of the drawings and the invention will be more fully apparent and understood in view of the detailed description.

DETAILED DESCRIPTION OF THE INVENTION

Reference will now be made in detail to various embodiments of the invention, examples of which are illustrated in the accompanying drawings, wherein like numerals indicate similar elements throughout the views.

The present invention provides an ink tank configured to supply ink to an inkjet printhead for a printing device at backpressures that vary less than conventional ink tanks. While the exemplary embodiments illustrated herein describe ink tanks for inkjet printer technology, as will be apparent to those of ordinary skill in the art the present invention may be employed in other ink tanks for print technologies such as printheads for print cartridges for inkjet printers, toner cartridges for laser printers, ink tanks for fax, photo printers, all-in-one devices, or plotters, or any other device incorporating printing technology.

Referring to FIG. 1, an exemplary embodiment of an ink tank 10 of the present invention is shown. Ink tank 10 includes a housing 12 that generally includes six walls: top wall 12*a*; bottom wall 12*b* and four side walls 12*c*. Housing 12 may be fabricated from any conventional materials used in ink tanks as known to one of ordinary skill in the art. Exemplary materials include but are not limited to polymers, plastics, ceramics, metal, fabric, wood and the like. In one exemplary embodiment, the ink tank 10 is molded from a polymeric material selected from the group consisting of glass-filled polybutylene terephthalate available from G.E. Plastics of Huntersville, N.C. under the trade name VALOX 855, amorphous thermoplastic polyetherimide available from G.E. Plastics under the trade name ULTEM 1010, glass-filled thermoplastic polyethylene terephthalate resin available from Dow Chemical Company of Midland, Mich., under the trade name QUESTRA, polyphenylene ether/polystyrene alloy resin available from G.E. Plastics under the trade name NORYL SEI and NORYL 300X and polyamide/poly-phenylene ether alloy resin available from G.E. Plastics under the trade name NORYL GTX.

Ink tank may also include a reservoir 11 and a partition wall 18 that separates reservoir 11 into a first chamber 14 and a second chamber 16. Partition 18 (e.g., a wall) extends downwardly from top wall 12*a* toward bottom wall 12*b*. A communication port 26 positioned between partition wall 18 and bottom wall 12*b* connects first chamber 14 in fluid communication with second chamber 16.

A tank outlet 28 for supplying ink from the reservoir 11 to a print head (not shown) is disposed within a wall (e.g., bottom wall 12*b*) of housing 12. Ink tank 10 also may include one or more capillary pressure producing members disposed within first and/or second chambers 14 and 16, respectively. In the exemplary embodiment shown in FIG. 1, second chamber 16 includes a free ink space 30 for containing free ink and a high capillary pressure producing member 20 positioned over tank outlet 28 within second chamber 16. High capillary pressure producing member 20 is positioned within second chamber 16 such that it is in direct communication with space 30 and outlet 28, permitting free ink to flow from space 30 through high capillary member 20 and exit outlet 28 without having to flow through communication port 26. "High capillary pressure", as used herein, is a capillary pressure of at least about 8 $cmH_2O$. "High capillary pressure producing member" 20, as used herein, a capillary pressure producing member comprising a capillary operating pressure of greater than or equal to about 8 $cmH_2O$. An exemplary high capillary pressure producing member that may be used with the present invention may comprise a random orientation felt with a density of 0.12 g/cc to 0.24 g/cc. Exemplary capillary materials include polyester, polyethylene or polypropylene fibers of 14 micrometer to 20 micrometer diameter.

It is understood that second chamber 16 may include additional capillary pressure producing members in addition to high capillary pressure producing member 20. It is also understood that a capillary pressure producing member rated at a operating capillary pressure different than high capillary pressure member 20 (e.g., less than 8 $cmH_2O$) may be used in place of high capillary pressure producing member 20. Exemplary capillary pressure producing members that may be used with the present invention include, but are not limited to, conventional hydrophobic foam material such as unfelted polyurethane open cell foam, fiber materials such as polyethylene, polypropylene, polyester or any blend thereof, felted foams, and other capillary pressure producing members as known to one of ordinary skill in the art.

As used herein, "direct communication" is defined as fluid communication between two components or elements (e.g., high capillary pressure producing member 20 and first space 30) such that a fluid (e.g., ink) may flow from the first component (e.g., first space 30) to the second component (e.g., high capillary pressure producing member 20) without requiring the fluid to flow through any other component or element. For example, as shown in FIG. 1, since first space 30 is in direct communication with high capillary pressure producing member 20, ink may flow from first space 30 to high capillary pressure producing member 20 without having to flow over, through, or around any other component or element, such as communication port 26. Moreover, since high capillary pressure producing member 20 is in direct communication with outlet 28, the ink that entered and flowing through high capillary pressure producing member 20 from first space 30 may flow directly from high capillary pressure producing member 20 into and out of outlet 28 without having to flow over, through, or around any other component or element.

First chamber 14 may, in the exemplary embodiment shown, include any conventional capillary pressure producing members at a variety of operating capillary pressures. In the exemplary embodiment, first chamber 14 includes a low capillary pressure producing member 22 and a medium capillary pressure producing member 24.

Low capillary pressure producing member 22 may be positioned in the upper portion of first chamber 14 such that it is adjacent top wall 12*a*. Medium capillary pressure producing member 24 may be positioned in the lower portion of first chamber 14 below low capillary pressure producing member 22 such that the low capillary pressure producing member is adjacent to bottom wall 12*b* and in direct communication with communication port 26. Low capillary pressure producing member 22 may comprise an operating capillary pressure from about 3 $cmH_2O$ to about 6 $cmH_2O$. Medium capillary producing member 24 may comprise an operating capillary pressure from about 5 $cmH_2O$ to about 10 $cmH_2O$. Exemplary low and medium capillary pressure producing members that may be used with the present invention are random orientation felts with densities of 0.10 g/cc to 0.15 g/cc of 20 micrometer to 40 micrometer diameter fibers and 0.10 g/cc to 0.20 g/cc of 15 micrometer to 35 micrometer diameter fibers, respectively.

Ink tank 10 may also include an ambient air vent 32 disposed within housing 12, providing an opening for ambient air to enter into the reservoir. As shown in FIG. 1, vent 32 is disposed in top wall 12*a* venting air into first chamber 14. In addition, partition 18 may include an air path 34 that runs from communication port 26 to first space 30 such that air may flow from first chamber 14 to first space 30 within second chamber 16 without having to flow through high capillary pressure producing member 20. As shown in FIG. 1, air path 34 is a groove or channel within partition 18 on the second chamber's side that begins at communication port 26 and ends (or exits) at a point just above high capillary pressure producing member 20 into first space 30. In the exemplary embodiment, air path 34 is capable of sustaining a minimum static back pressure of 6 cm $H_2O$. It is understood that any number of conventional methods of providing the air path may be used with the present invention as known to one of ordinary skill in the art without departing from the spirit and scope of the present invention.

Ink tank 10 may also include a sensor operable to detect the ink and/or the level of ink within the tank. The sensor can be included within the reservoir to detect the presence of ink so that printing may be stopped before the reservoir empties completely. If printing continues after the reservoir has emptied, the printhead may deprime and fail. In the exemplary embodiment, ink sensor 13 is placed substantially along the bottom of and within first space 30 (just above high capillary pressure producing member 20). Ink sensor 13 is configured to detect the presence of ink and/or the lack thereof contained within first space 30 and stop the printing process if no ink is detected. Since sensor 13 is positioned within first space 30 (and the free ink), sensor 13 may comprise an optical sensor to gauge the volume of ink remaining in the tank in order to stop the printing before the printhead deprimes. It is understood that sensor 13 may be positioned in other places within ink tank 10 and that other conventional ink sensors may be used with the present invention as known to one of ordinary skill in the art, including but not limited to infrared and Hall effect sensors.

Still referring to FIG. 1, when the printing operation begins, ink tank 10 begins supplying ink to the printhead via outlet 28 from high capillary pressure producing member 20. As the ink from high capillary pressure producing member 20 is supplied to outlet 28, ink may drain from first chamber 14, i.e., via communication port 26 from medium capillary pressure member 24 and low capillary pressure member 22, before flowing from second chamber 16.

As the ink is consumed from ink tank 10, a boundary 15 between the ink and ambient air will move down first chamber 14 (e.g., through low capillary pressure producing member 22 and then medium capillary pressure producing member 24) until boundary reaches communication port 26. At which point, air begins to flow through communication port 26 and air path 34 into first space 30, which rises to the top of second chamber 16 (e.g., first space 30) to form a second boundary (not shown) at the top of first space 30 between ambient air and first ink in first space 30. As the ink is continued to be consumed, the second boundary moves down first space 30 until it reaches a level adjacent sensor 13. At which point, sensor 13 signals the printing device to stop the printing operation to protect the printhead from depriming.

Figure 2:
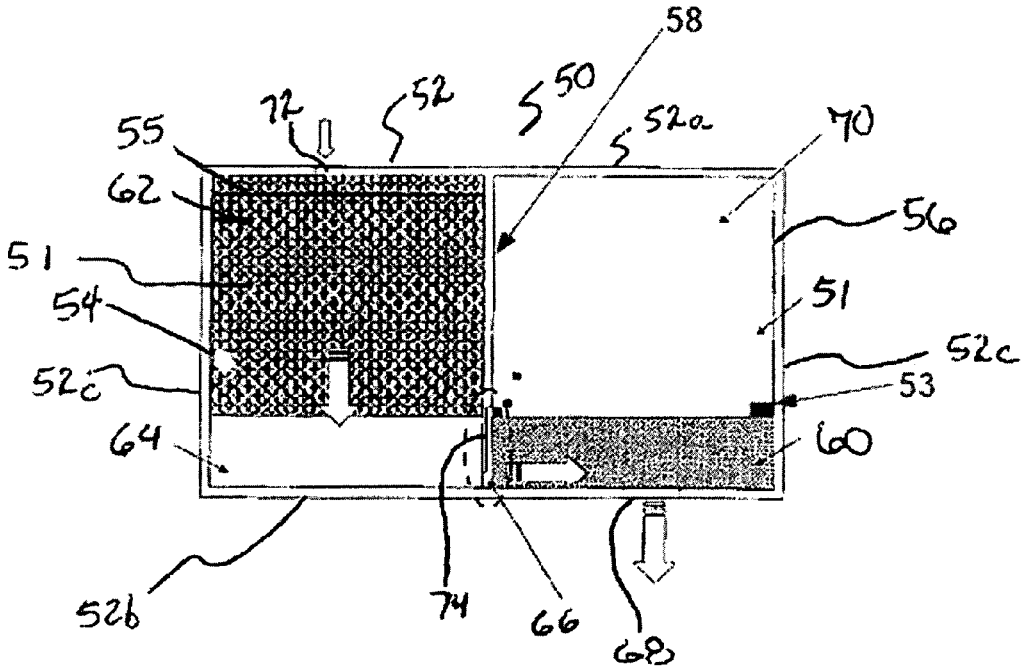
FIG. 2 is a schematic representation of another exemplary embodiment of the ink tank for an inkjet printing device according to the present invention.

Referring to FIG. 2, another exemplary embodiment of an ink tank 50 for an inkjet printhead is shown. Ink tank 50 is generally the same as ink tank 10 in the first exemplary embodiment except for ink tank 50 includes a second free ink space 64 positioned where and instead of a medium capillary pressure producing member as found in ink tank 10. In the exemplary embodiment shown in FIG. 2, ink tank 50 includes a housing 52 that has six walls: top wall 52*a*, bottom wall 52*b* and four side walls 52*c*. Housing 52 may be fabricated from any conventional materials used in ink tanks as known to one of ordinary skill in the art and as described above herein. Ink tank 50 may also include a reservoir 51 and a partition 58 (e.g., a wall) that separates reservoir 51 into a first chamber 54 and a second chamber 56. Partition 58 extends downwardly from top wall 52*a* toward bottom wall 52*b*. A communication port 66 positioned between partition 58 and bottom wall 52*b* connects first chamber 54 in fluid communication with second chamber 56.

A tank outlet 68 for supplying ink from the reservoir 51 to a print head (not shown) is disposed within a wall (e.g., bottom wall 52*b*) of housing 52. Ink tank 50 also may include one or more capillary pressure producing members disposed within first and/or second chambers 54 and 56, respectively. In the exemplary embodiment shown in FIG. 1, second chamber 56 includes a first free ink space 70 for containing free ink and a high capillary pressure producing member 60 positioned over tank outlet 68 within second chamber 56. High capillary pressure producing member 60 is positioned within second chamber 56 such that it is in direct communication with first space 70 and outlet 68, thus permitting free ink to flow directly from first space 70 through high capillary member 60 and then flow from high capillary pressure member 60 directly to and through outlet 58 without having to flow through any other element or component such as communication port 66. "High capillary pressure" and "High capillary pressure producing member" are defined as set forth above herein. "Direct communication" is defined as set forth above herein. An exemplary high capillary pressure producing member that may be used with the present invention may comprise a random orientation felt with a density of 0.12 g/cc to 0.24 g/cc. Exemplary capillary materials include polyester, polyethylene or polypropylene fibers of 14 micrometer to 20 micrometer diameter.

It is understood that second chamber 56 may include additional capillary pressure producing members in addition to high capillary pressure producing member 60. It is also understood that a capillary pressure producing member rated at a operating capillary pressure different than the high capillary pressure (e.g., less than 10 cm $cmH_2O$) may be used in place of high capillary pressure producing member 60. Exemplary capillary pressure producing members that may be used with the present invention include, but are not limited to, conventional hydrophobic foam material such as unfelted polyurethane open cell foam, fiber materials such as polyethylene, polypropylene, polyester or any blend thereof, felted foams, and other capillary pressure producing members as are known to one of ordinary skill in the art.

First chamber 54 may comprise any type of conventional capillary pressure producing member at a variety of operating capillary pressures. In the exemplary embodiment, first chamber 54 includes a low capillary pressure producing member 62 positioned in the upper portion of first chamber 54 such that it is adjacent top wall 52*a*. In the lower portion of first chamber 54 (adjacent bottom wall 52*b*), a second free space 64 for containing free ink is provided within the reservoir 51. Second free space 64 is adjacent to and in direct communication with communication port 66. In this exemplary embodiment, low capillary pressure member 62 controls the bubbling pressure. Low capillary pressure producing member 62 may comprise an operating capillary pressure from about 3 $cmH_2O$ to about 6 $cmH_2O$. Exemplary low capillary pressure producing members that may be used with the present invention are random orientation felts with densities of 0.10 g/cc to 0.15 g/cc of 20 micrometer to 40 micrometer diameter fibers.

Ink tank 50 may also include an ambient air vent 72 disposed within housing 52, providing an opening for ambient air to enter into the reservoir. As shown in FIG. 2, vent 72 is disposed in top wall 52*a* venting air into first chamber 54. In addition, partition 58 may include an air path 74 that runs from communication port 66 to first space 70 such that air may flow from first chamber 54 to first space 70 within second chamber 56 without having to flow through high capillary pressure producing member 60. As shown in FIG. 2, air path 74 is a groove or channel within partition 58 on the second chamber's side that begins at communication port 66 and ends (or exits) at a point just above high capillary pressure producing member 60 into first space 70. In the exemplary embodiment, air path 74 is capable of sustaining a minimum static back pressure of 6 cm $H_2O$. It is understood that any number of conventional methods of providing the air path may be used with the present invention as known to one of ordinary skill in the art without departing from the spirit and scope of the present invention.

Ink tank 50 may also include a sensor operable to detect the ink and/or the level of ink within the tank. The sensor is included within the reservoir to detect the presence of ink so that printing may be stopped before the reservoir empties completely. In the exemplary embodiment, ink sensor 53 is placed substantially along the bottom of and within first space 70 (just above high capillary pressure producing member 60). As set forth above in ink tank 50, ink sensor 53 is configured to detect the presence of ink and/or the lack thereof contained within reservoir 51 (e.g., first space 70) and stop the printing process if no ink is detected. Sensor 53 may be any conventional sensor (e.g., optical sensor to gauge the volume of ink) as known to one of ordinary skill in the art. It is understood that sensor 53 may be positioned in other places within ink tank 50 (e.g., second space 64) and that more than one sensor may be used with ink tank 50. Other conventional ink sensors may be used with the present invention as known to one of ordinary skill in the art, including but not limited to infrared and Hall effect sensors.

As ink is supplied to printhead during printing operations via outlet 68, the ink will drain from second chamber 56 only after the free ink (e.g., ink in second space 64) and bound ink (e.g., ink in low capillary pressure member 62) in first chamber 54 has drained. As the ink is consumed from ink tank 50, a boundary 55 between the ink and ambient air will move down first chamber 54 (e.g., through low capillary pressure producing member 62 and then second free ink space 64) until boundary reaches communication port 66. At which point, air begins to flow through communication port 66 and air path 74 into first space 70, which rises to the top of second chamber 56 (e.g., first space 70) to form a second boundary (not shown) at the top of first space 70 between ambient air and free ink in first space 30. As the ink is continued to be consumed, the second boundary moves down first space 70 until it reaches a level adjacent sensor 53. At which point, sensor 53 signals the printing device to stop the printing operation to protect the printhead from depriming.

The exemplary embodiment shown in FIG. 2 has several advantages over the exemplary embodiment shown in FIG. 1. For example, since ink tank 50 has second free space 64, it has an increased ink volume, which translates into an increased page yield for ink tank 50 over ink tank 10. Additionally, ink tank 50 comprises a better tolerance of ambient pressure changes. Since ink drains first from first chamber 54 before draining from second chamber 56, if ink tank 50 is subjected to a decrease in ambient pressure (e.g., as occurs during a thunderstorm), the air volume above first space 70 will expand. The ink will flow along the path of least resistance and thus will flow from second chamber 56 to second space 64 via communication port 66. This is beneficial in the case of a rapid change in pressure since it takes time for the capillary pressure producing members to absorb ink.

Figure 3:
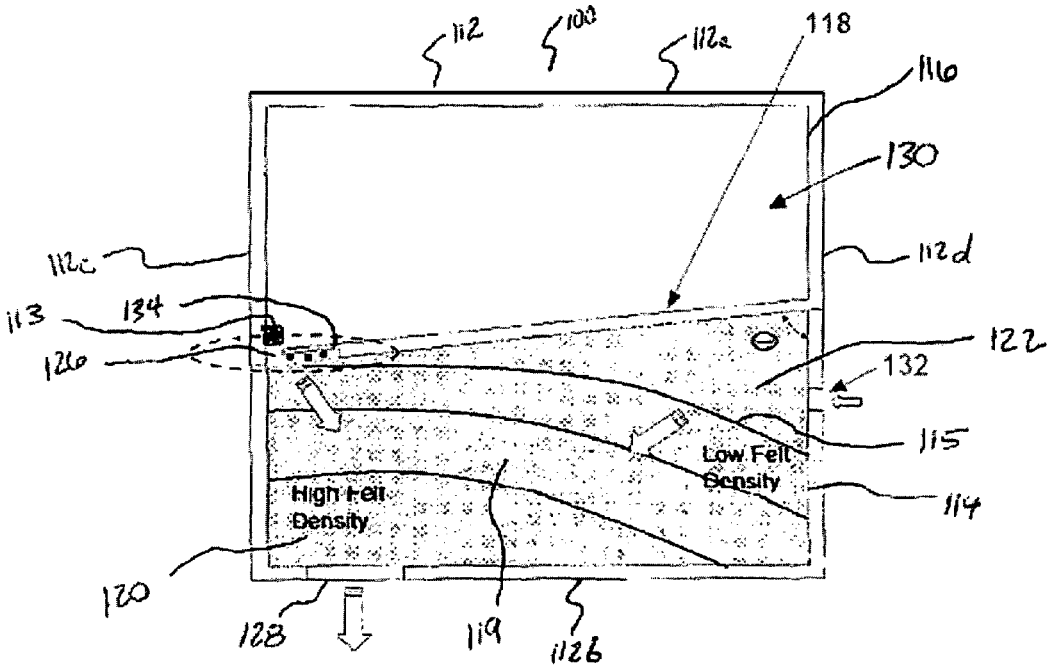
FIG. 3 is a schematic representation of another exemplary embodiment of the ink tank for an inkjet printing device according to the present invention.

Referring to FIG. 3, another exemplary embodiment of the present invention is shown as ink tank 100. As shown, ink tank 100 includes a housing 112, first chamber 114, second chamber 116, a communication port 126, and a tank outlet 128. Housing 112 includes a top wall 112*a*, bottom wall 112*b*, and four side walls (two of which are shown as left side wall 112*c* and right side wall 112*d*). Housing 112 may be fabricated from any conventional materials used in ink tanks as known to one of ordinary skill in the art and as described above herein. First and second chamber 114 and 116, respectively, are separated by a partition 118 that extends from right side wall 112*d* to the left toward left side wall 112*c* to communication port 126. Communication port 126 extends between partition 118 and left side wall 112*c* such that it places first chamber 114 in fluid communication with second chamber 116.

Ink tank 100 may also include an air path 134 that provides a path from communication port 126 to first chamber 114 and ultimately to an ambient air vent 132. First chamber 114 comprises a capillary pressure producing member 119 (e.g., random orientation felt). Second chamber 116 comprises a first free space 130 for containing free ink. Second chamber 116 (first space 130) is positioned above first chamber 114.

In the exemplary embodiment shown in FIG. 3, partition 118 extends to the left in a downward angle θ from the vertical left side wall in order to compress capillary pressure producing member 119 more on the left side compared to the right side. Because the capillary pressure producing member 110 is compressed more on one side, the density of the capillary pressure producing member increases for that section (side) and thus the operating capillary pressure of the more dense section increases. For example, angle θ may be about 75 degrees downward from left to right, thus causing the left portion of capillary pressure producing member 119 to become a high capillary pressure producing member 120 and the right portion of capillary pressure producing member 119 to maintain a low capillary pressure producing member 122. It is understood that angle θ may comprise any angle depending upon the original density of the capillary pressure producing member and thus the required compression to create desired capillary pressure.

In this exemplary embodiment, outlet 128 is disposed within bottom wall 112*b* and thus in fluid communication with first chamber 114. As set forth above, ink tank 100 also includes vent 132, which is disposed within right side wall 112*d*, placing ambient air in fluid communication with first chamber 114. In addition, when the ink drains from first chamber 114 such that a boundary 113 between the ink and ambient air passes air path 134, vent 132 is placed in fluid communication with first space 130.

When printing begins and inks begins to be supplied from ink tank 100 from outlet 128, low capillary pressure producing member 122 (portion closest to vent 132 begins to drain or empty of ink first. The liquid level (e.g., boundary 115) lowers until an air path is established from air vent 132 to first free ink space 130. The air path 134 is configured to control the pressure at which the free ink drains into the first chamber 114. The flow of free ink from free space 130 into high capillary pressure producing member 120 keeps it saturated until the free ink volume has been exhausted. A sensor 113 may be positioned in first space 130 such that it may detect the presence of ink in free space 130 or lack thereof, in order to signal the printing device to stop printing.

Accordingly, while some of the alternative embodiments of the present invention have been discussed specifically; other embodiments will be apparent or relatively easily developed by those of ordinary skill in the art. Accordingly, this invention is intended to embrace all alternatives, modifications and variations that have been discussed herein, and others that fall within the spirit and broad scope of the claims.

What is claimed is:

1. An ink tank for an inkjet printing device, comprising:
- a housing for containing ink;
- first and second chambers within the housing;
- a partition separating the first and second chambers;
- a communication port connecting the first chamber in fluid communication with the second chamber;
- a tank outlet disposed within a wall of the second chamber;
- a high capillary pressure producing member in direct communication with the outlet and disposed within the second chamber
- a first space for containing free ink disposed above the high capillary pressure producing member; and
- a low capillary pressure producing member disposed within an upper portion of the first chamber, leaving a second space in a lower portion of the first chamber.

2. The ink tank according to claim 1, wherein the first space is disposed within the second chamber such that the first space is in direct communication with the high capillary pressure producing member.

3. The ink tank according to claim 1, wherein the ink tank is configured to maintain a backpressure from about 3 $cmH_2O$ to about 25 $cmH_2O$.

4. The ink tank according to claim 1, wherein the high capillary pressure producing member is positioned directly over the outlet.

5. The ink tank according to claim 1, wherein the high capillary pressure producing member comprises an operating capillary pressure of at least about 10 $cmH_2O$.

6. The ink tank according to claim 1, wherein the low capillary pressure producing member comprises an operating capillary pressure from about 3 $cmH_2O$ to about 6 $cmH_2O$.

7. The ink tank according to claim 1, further comprising a medium capillary pressure producing member disposed within the second space.

8. The ink tank according to claim 1, further comprising an air path running from the first chamber to the second chamber.

9. The ink tank according to claim 1, further comprising a vent disposed within the first chamber to connect the interior of the first chamber to ambient air.

10. The ink tank according to claim 1, wherein, the second space is in direct communication with the low capillary pressure producing member and the communication port.

11. The ink tank according to claim 1, further comprising a sensor for detecting the level of ink contained within the first space.

12. The ink tank according to claim 1, wherein the partition is disposed at a non-perpendicular angle from a wall of the housing opposite the communication port.

13. The ink tank according to claim 1, wherein the second space is a space for containing free ink.

14. An ink tank for an inkjet printing device, comprising:

a housing;

first and second chambers for containing ink disposed within the housing;

a partition separating the first and second chambers;

a communication port connecting the first chamber in fluid communication with the second chamber;

a first capillary pressure producing member disposed within the second chamber;

a tank outlet disposed within a wall of the second chamber;

a first space for containing free ink disposed within the second chamber and disposed above the first capillary pressure producing member within the second chamber; and a second capillary pressure producing member disposed within an upper portion of the first chamber such that a lower portion of the first chamber includes a second space.

15. The ink tank according to claim 14, wherein the first capillary pressure producing member is in direct communication with the first space and the outlet.

16. The ink tank according to claim 14, wherein the first capillary pressure producing member comprises an operating capillary pressure of at least about 10 $cmH_2O$.

17. The ink tank according to claim 14, wherein the the second capillary pressure producing member is a low capillary pressure producing member.

18. The ink tank according to claim 17, further comprising a medium capillary pressure producing member disposed within the second space.

19. The ink tank according to claim 14, wherein the second space is a space for containing free ink.

20. A ink tank for an inkjet printing device, comprising:

a housing;

first and second chambers for containing ink disposed within the housing;

a communication port connecting the first chamber in fluid communication with the second chamber;

a tank outlet disposed within a wall of the second chamber;

a high capillary pressure producing member disposed above the outlet within the second chamber;

a first space for containing free ink disposed above the high capillary pressure producing member within the housing such that free ink may flow substantially downward from the first space through the capillary pressure producing member and exit the outlet;

a low capillary pressure producing member disposed within an upper portion of the first chamber; and a medium capillary pressure producing member disposed within a lower portion of the first chamber in direct communication with the low capillary pressure producing member and the communication port.

* * * * *